US010030658B2

(12) United States Patent
Wood

(10) Patent No.: US 10,030,658 B2
(45) Date of Patent: Jul. 24, 2018

(54) CONCENTRIC VANE COMPRESSOR

(71) Applicant: Mark W. Wood, Cedar Grove, TN (US)

(72) Inventor: Mark W. Wood, Cedar Grove, TN (US)

( * ) Notice: Subject to any disclaimer, the term of this patent is extended or adjusted under 35 U.S.C. 154(b) by 108 days.

(21) Appl. No.: 15/139,608

(22) Filed: Apr. 27, 2016

(65) Prior Publication Data

US 2017/0314559 A1 Nov. 2, 2017

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 18/344*** | (2006.01) |
| ***F04C 27/00*** | (2006.01) |
| ***F04C 29/12*** | (2006.01) |
| ***F04C 15/06*** | (2006.01) |

(52) U.S. Cl.

CPC ..... *F04C 18/3441* (2013.01); *F04C 15/06* (2013.01); *F04C 18/3443* (2013.01); *F04C 27/001* (2013.01); *F04C 29/124* (2013.01)

(58) Field of Classification Search

CPC ..... F04C 18/3441; F04C 18/3443; F04C 11/001; F04C 15/06; F04C 23/001; F04C 23/008; F04C 27/001; F04C 29/12; F04C 29/124; F01C 1/3441; F01C 1/3443

USPC ..... 418/6, 11, 15, 58–59, 60, 63, 104, 112, 418/150, 172, 175–177, 209–210, 212, 418/225, 64

See application file for complete search history.

(56) References Cited

U.S. PATENT DOCUMENTS

| | | | | |
|---|---|---|---|---|
| 1,872,361 | A * | 8/1932 | Tackman | F04C 18/3441 418/175 |
| 4,568,253 | A | 2/1986 | Wood | |
| 4,629,403 | A | 12/1986 | Wood | |
| 5,169,299 | A | 12/1992 | Gannaway | |
| 5,222,885 | A | 6/1993 | Cooksey | |

(Continued)

FOREIGN PATENT DOCUMENTS

| | | | |
|---|---|---|---|
| EP | 1233186 | B1 | 9/2004 |
| WO | 2015147744 | A1 | 10/2015 |

OTHER PUBLICATIONS http://docs.lib.purdue.edu/cgi/viewcontent.cgi?article=3316&context=icec.

International Search Report and Written Opinion dated May 30, 2017 for PCT/US2017/020162.

*Primary Examiner* — Theresa Trieu

(74) *Attorney, Agent, or Firm* — Kevin E. West; Advent, LLP

(57) ABSTRACT

A positive displacement device includes a first cylinder, a second cylinder disposed within the first cylinder, and a third cylinder disposed around the first cylinder. An interior surface of the first cylinder and an exterior surface of the second cylinder define an inner cavity. An exterior surface of the first cylinder and an interior surface of the third cylinder define an outer cavity. A partition between the interior surface of the first cylinder and the exterior surface of the second cylinder divides the inner cavity into inner regions, and another partition between the exterior surface of the first cylinder and the interior surface of the third cylinder divides the outer cavity into outer regions. The second cylinder and the third cylinder orbit with respect to the first cylinder to create alternating regions of high pressure and low pressure in the inner regions and the outer regions.

20 Claims, 13 Drawing Sheets

(56) References Cited

U.S. PATENT DOCUMENTS

| | | | | |
|---|---|---|---|---|
| 5,399,076 | A | 3/1995 | Matsuda et al. | |
| 6,607,371 | B1 | 8/2003 | Raymond et al. | |
| 6,746,223 | B2 | 6/2004 | Manole | |
| 7,341,437 | B2 | 3/2008 | Hwang et al. | |
| 7,367,790 | B2 | 5/2008 | Hwang et al. | |
| 8,517,702 | B2 | 8/2013 | Byun et al. | |
| 2006/0056988 | A1 | 3/2006 | Seok et al. | |
| 2010/0119378 | A1* | 5/2010 | Shibamoto ..... | F04C 18/3441 418/175 |
| 2013/0011290 | A1* | 1/2013 | Okamoto ..... | F04C 18/3441 418/175 |

* cited by examiner

CONCENTRIC VANE COMPRESSOR

BACKGROUND

Vane compressors generally include a stationary or fixed cylinder with a slot for a reciprocating vane. An orbiting cylinder is positioned within the fixed cylinder, and the reciprocating vane (e.g., with a vane spring) is inserted into the vane slot on the outer fixed cylinder, with one end maintaining contact with the smaller orbiting cylinder. The vane provides a barrier between high and low pressure regions within a cylinder cavity formed between the stationary or fixed cylinder and the orbiting cylinder.

SUMMARY

A positive displacement device includes a first cylinder, a second cylinder disposed within the first cylinder, and a third cylinder disposed around the first cylinder. An interior surface of the first cylinder and an exterior surface of the second cylinder define an inner cavity. An exterior surface of the first cylinder and an interior surface of the third cylinder define an outer cavity. A partition between the interior surface of the first cylinder and the exterior surface of the second cylinder divides the inner cavity into inner regions, and another partition between the exterior surface of the first cylinder and the interior surface of the third cylinder divides the outer cavity into outer regions. The second cylinder and the third cylinder orbit with respect to the first cylinder to create alternating regions of high pressure and low pressure in the inner regions and the outer regions.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
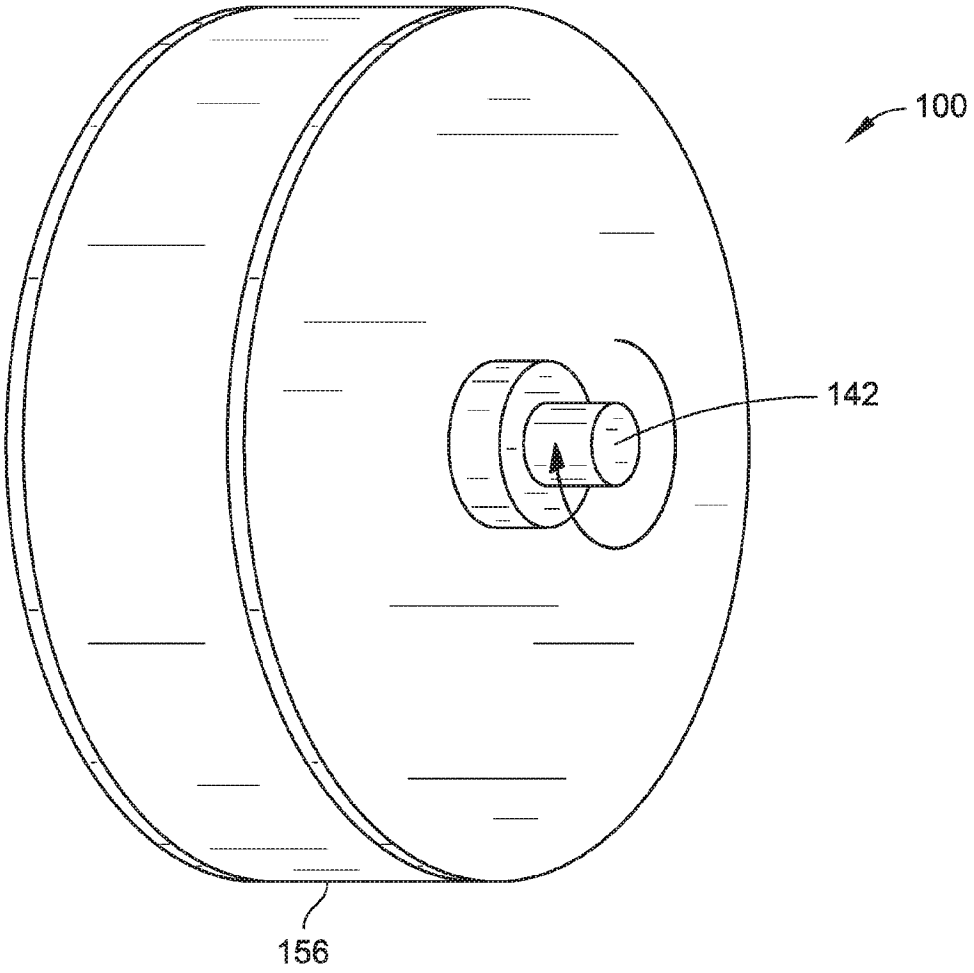
FIG. 1 is a perspective view illustrating a positive displacement device in accordance with example embodiments of the present disclosure.
Figure 2:
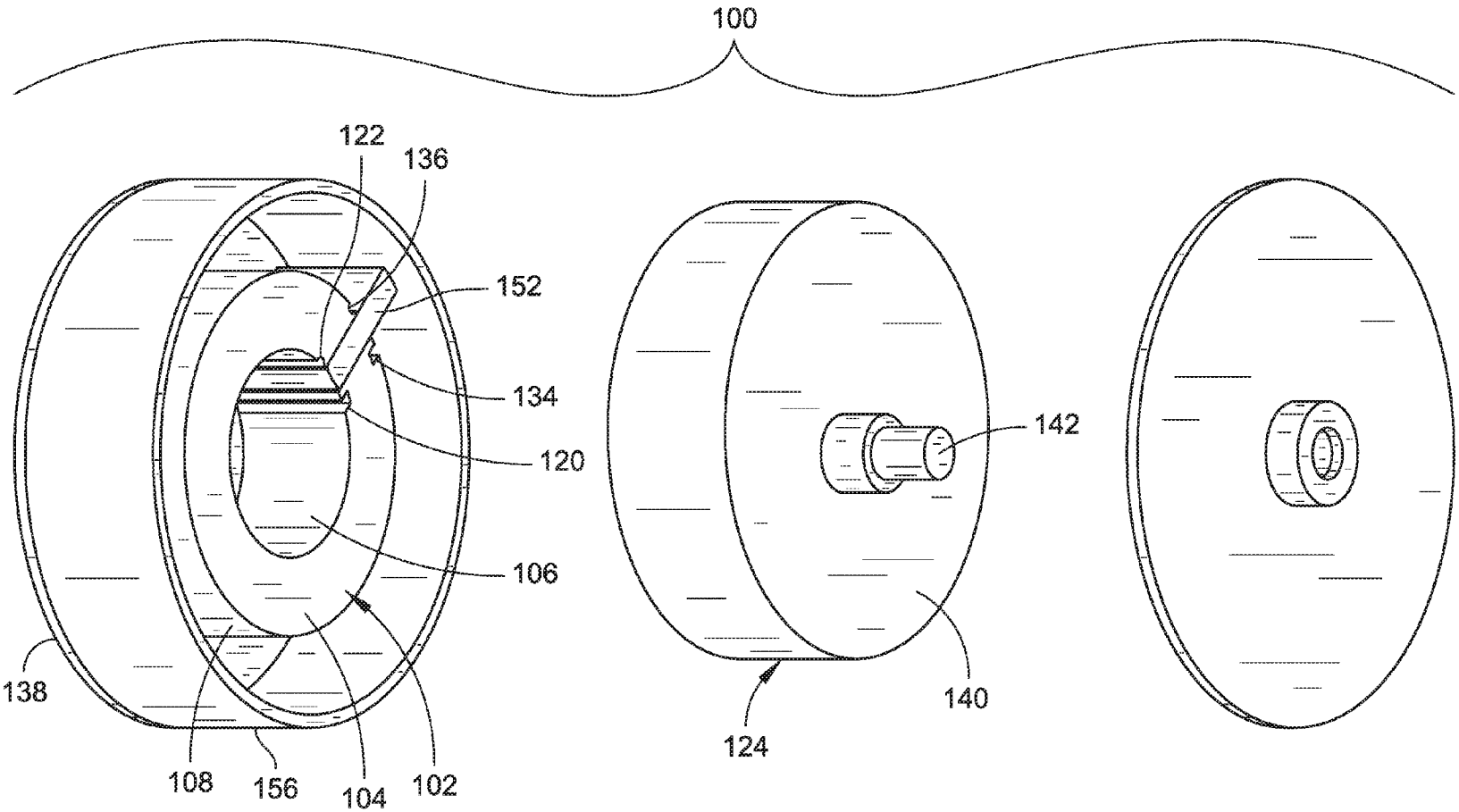
FIG. 2 is an exploded perspective view of the positive displacement device illustrated in FIG. 1.
Figure 3:
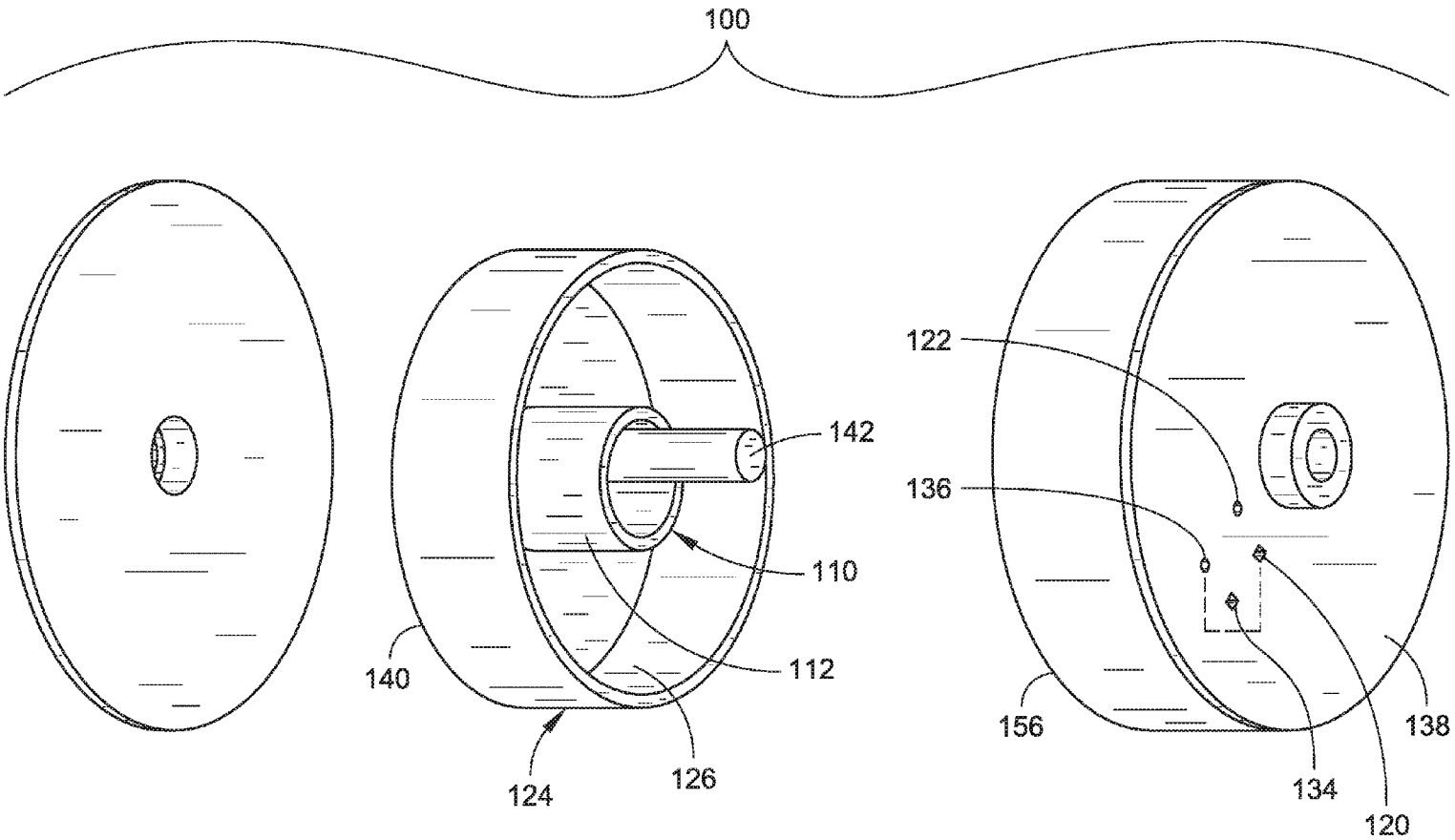
FIG. 3 is another exploded perspective view of the positive displacement device illustrated in FIG. 1.

A conventional vane compressor is comprised of a stationary or fixed cylinder with a slot for receiving a reciprocating vane, an orbiting cylinder, a reciprocating vane with a vane spring, bearings, and a crankshaft with an eccentrically mounted shaft. The vane is inserted into the vane slot on the outer fixed cylinder with one end maintaining contact with the smaller orbiting cylinder providing a barrier between high and low pressure within the cylinder cavity.

As described herein, a positive displacement device, which can be configured as a vane compressor, can include two orbiting cylinders, rigidly connected at one end by a plate, rather than one orbiting cylinder within a larger fixed cylinder. In embodiments of the disclosure, the inner cylinder is smaller than the fixed cylinder and the larger orbiting cylinder is larger than the fixed cylinder. In some embodiments, a common vane may pass through a vane slot in the fixed cylinder wall, maintaining sealing contact with both the inner and outer orbiting cylinder surfaces. In this configuration, the smaller orbiting cylinder controls the vane position from below while the larger orbiting cylinder controls the vane position from above. Thus, a vane spring, which is typically used to maintain contact between the vane tip radius and the orbiting cylinder, is not necessarily required.

While a conventional vane compressor provides one compression cavity divided into low and high pressure regions, the positive displacement devices described herein can provide two compression cavities, each divided into low and high pressure regions. The inner cavity is formed between the inner orbiting cylinder surface and the fixed cylinder surface, and has a smaller displaced volume than that of the outer cavity. The outer compression cavity is formed between the fixed cylinder surface and the outer orbiting cylinder surface, and has the larger displaced volume. Thus, a positive displacement device as described herein may be configured as either a single stage compressor or a two stage compressor, e.g., with a single fixed and orbiting cylinder set. For a two stage design, the larger outer cavity may be used for the first stage, and the smaller inner cavity may be used for the second stage.

It should be noted that the outer and inner compression cavities, while sharing a common vane and common orbiting and fixed cylinders, are two separate cavities with compression cycles sequenced one hundred and eighty degrees (180°) apart. This configuration can reduce peak compressor torque and/or associated noise and vibration while increasing motor running efficiency. Further, dual concentric sequential compression chambers can support the addition of flow control valves for switching between four levels of mass flow and single stage or two stage compression to increase efficiency (e.g., as weather conditions vary) while also enabling start relief (e.g., for the compressor motor). In embodiments of the disclosure, flow control valves can be located within a compressor enclosure and/or outside of the enclosure. When placed outside of a compressor enclosure, ease of maintenance and/or improved control wiring access may be provided. Additionally, an outside placement can provide for simplified control features and/or upgrade options with a common compressor design. Available features may range from a baseline unit without control valves, two or three additional mass flow levels plus single or two stage compression options, a start relief option, and so on. With outside flow control valves, these options may be available from a manufacturer and/or may added in the field.

Referring now to FIGS. 1 through 16, positive displacement devices 100 are described. A positive displacement device 100 can be used for various applications, including, but not necessarily limited to, pumping fluid and/or gas. For example, a positive displacement device 100 can be used as a compressor for refrigeration and/or air conditioning applications, and so forth. The apparatus, systems, and techniques described herein, can provide low cost, low noise, and/or high efficiency oil lubricated rotary compressors that can be used in, for example, refrigeration compressor applications. Using concentric sequential compression, a low clearance volume may be provided. Further, the positive displacement device 100 can facilitate start unloading. In some embodiments, a single wrap design allows for a reduced compressor diameter and/or leakage area (e.g., as compared to a multiple wrap design). Further, a positive displacement device 100 can provide higher liquid slugging tolerance (e.g., because the orbiting cylinders are not restricted from moving away from the stationary cylinder to relieve pressure spikes).

In embodiments of the disclosure, a positive displacement device 100 includes a first cylinder 102 having a wall 104 with an interior surface 106 and an exterior surface 108. The positive displacement device 100 also includes a second cylinder 110 disposed within the first cylinder 102. The second cylinder 110 has an exterior surface 112. The interior surface 106 of the first cylinder 102 and the exterior surface 112 of the second cylinder 110 define an inner cavity 114. The positive displacement device 100 also includes a partition between the interior surface 106 of the first cylinder 102 and the exterior surface 112 of the second cylinder 110 to divide the inner cavity 114 into a first inner region 116 and a second inner region 118, where a first intake port 120 is in fluid communication with the first inner region 116 of the inner cavity 114, and a first exhaust port 122 is in fluid communication with the second inner region 118 of the inner cavity 114.

The positive displacement device 100 also includes a third cylinder 124 disposed around the first cylinder 102. The third cylinder 124 has an interior surface 126. The exterior surface 108 of the first cylinder 102 and the interior surface 126 of the third cylinder 124 define an outer cavity 128. The positive displacement device 100 also includes another partition between the exterior surface 108 of the first cylinder 102 and the interior surface 126 of the third cylinder 124 to divide the outer cavity 128 into a first outer region 130 and a second outer region 132, where a second intake port 134 is in fluid communication with the first outer region 130 of the outer cavity 128, and a second exhaust port 136 is in fluid communication with the second outer region 132 of the outer cavity 128. For the purposes of the present disclosure, the term "third cylinder" shall be defined as any three-dimensional shape having a cylindrical interior surface, and shall encompass the shapes described with reference to the accompanying figures, along with other shapes not described in the accompanying figures. For example, a third cylinder as described herein may be a rectangular prism having a cylindrical interior surface, a hexagonal prism having a cylindrical interior surface, and so on.

The positive displacement device 100 includes one sealing interface for sealing first ends of the inner cavity 114 and the outer cavity 128, and another sealing interface for sealing second ends of the inner cavity 114 and the outer cavity 128. For example, the first cylinder 102 is connected to one end plate 138, and the second and third cylinders 110 and 124 are connected to another end plate 140. In embodiments of the disclosure, the second cylinder 110 and the third cylinder 124 are configured to orbit with respect to the center of the first cylinder 102 to create alternating regions of high pressure and low pressure in the first and second inner regions 116 and 118 of the inner cavity 114 and the first and second outer regions 130 and 132 of the outer cavity 128.

Figure 4B:
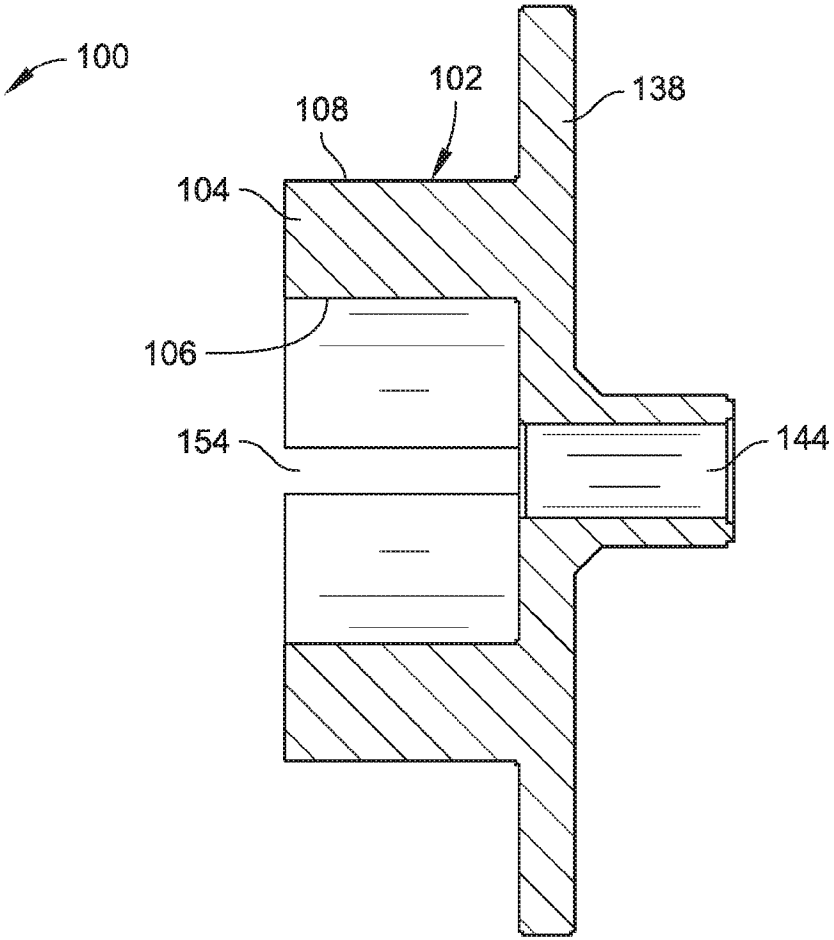
FIG. 4B is a partial cross-sectional side elevation view illustrating a stationary cylinder with a vane slot and a journal bearing for a positive displacement device in accordance with an example embodiment of the present disclosure.
Figure 4A:
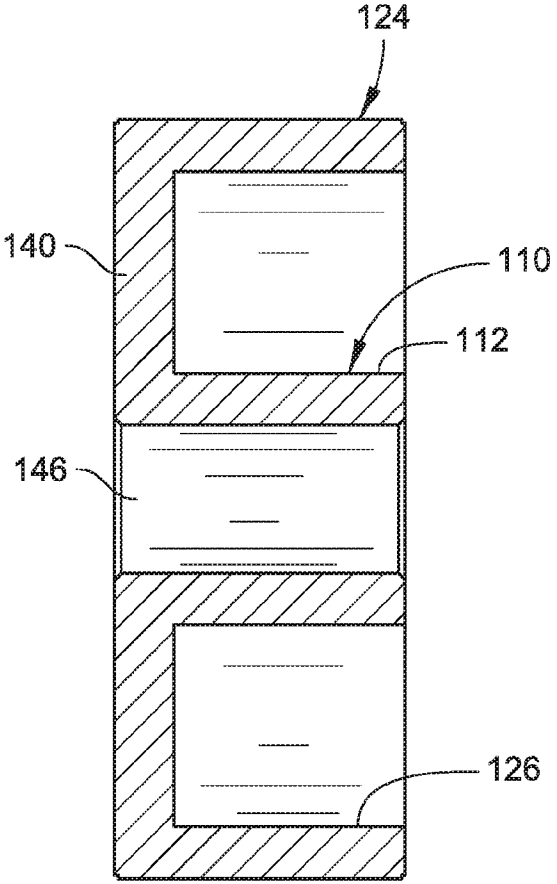
FIG. 4A is a partial cross-sectional side elevation view illustrating an orbiting cylinder pair with an eccentric journal bearing for a positive displacement device in accordance with an example embodiment of the present disclosure.
Figure 4C:
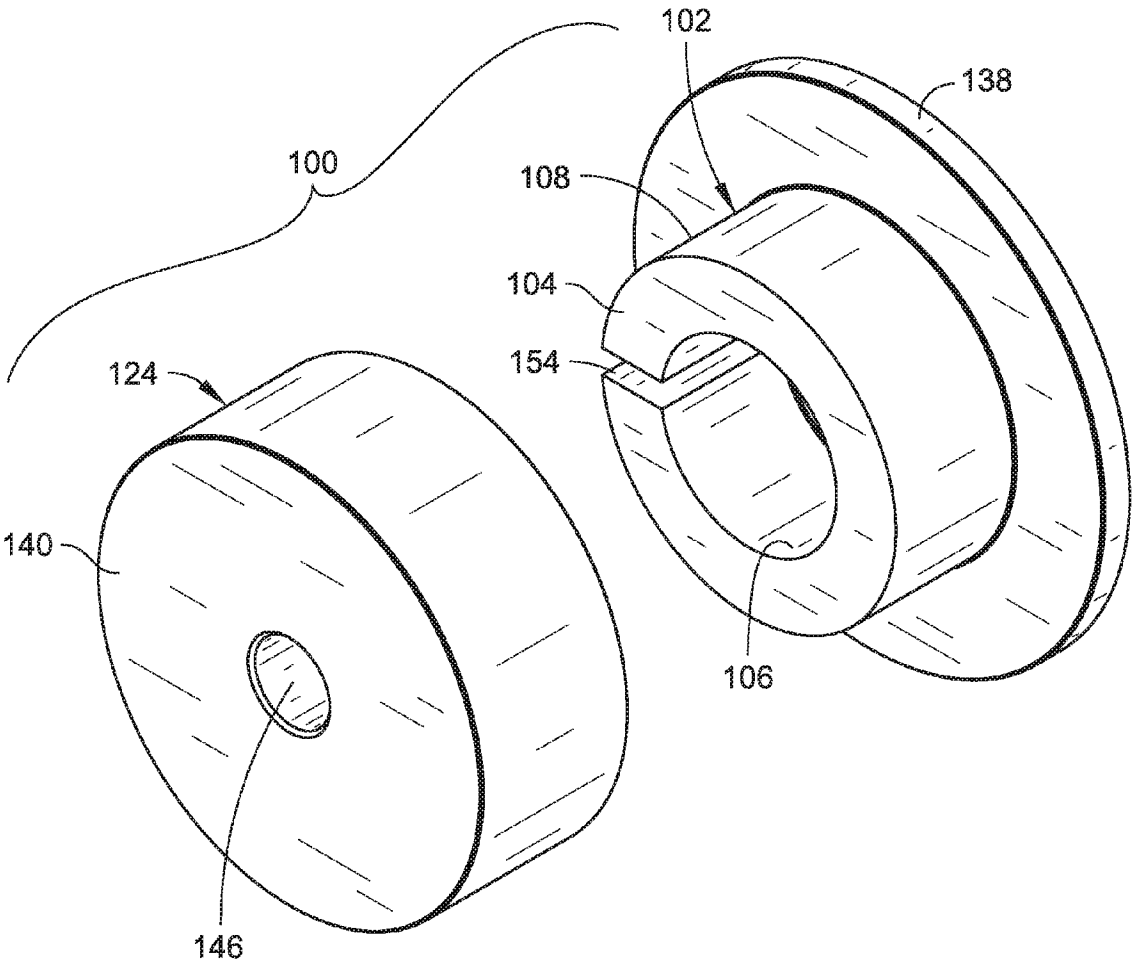
FIG. 4C is an exploded isometric view of the orbiting cylinder pair and the stationary cylinder illustrated in FIGS. 4A and 4B.
Figure 5:
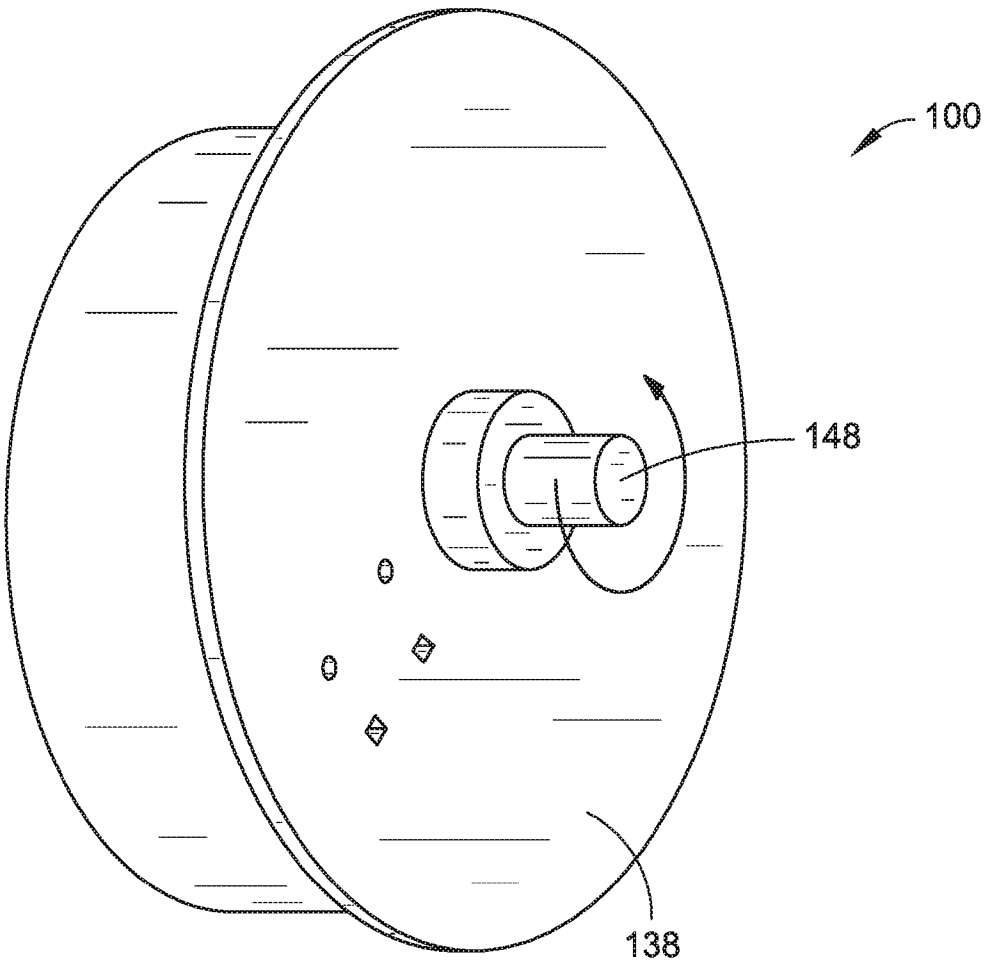
FIG. 5 is a perspective view illustrating another positive displacement device in accordance with example embodiments of the present disclosure.
Figure 6:
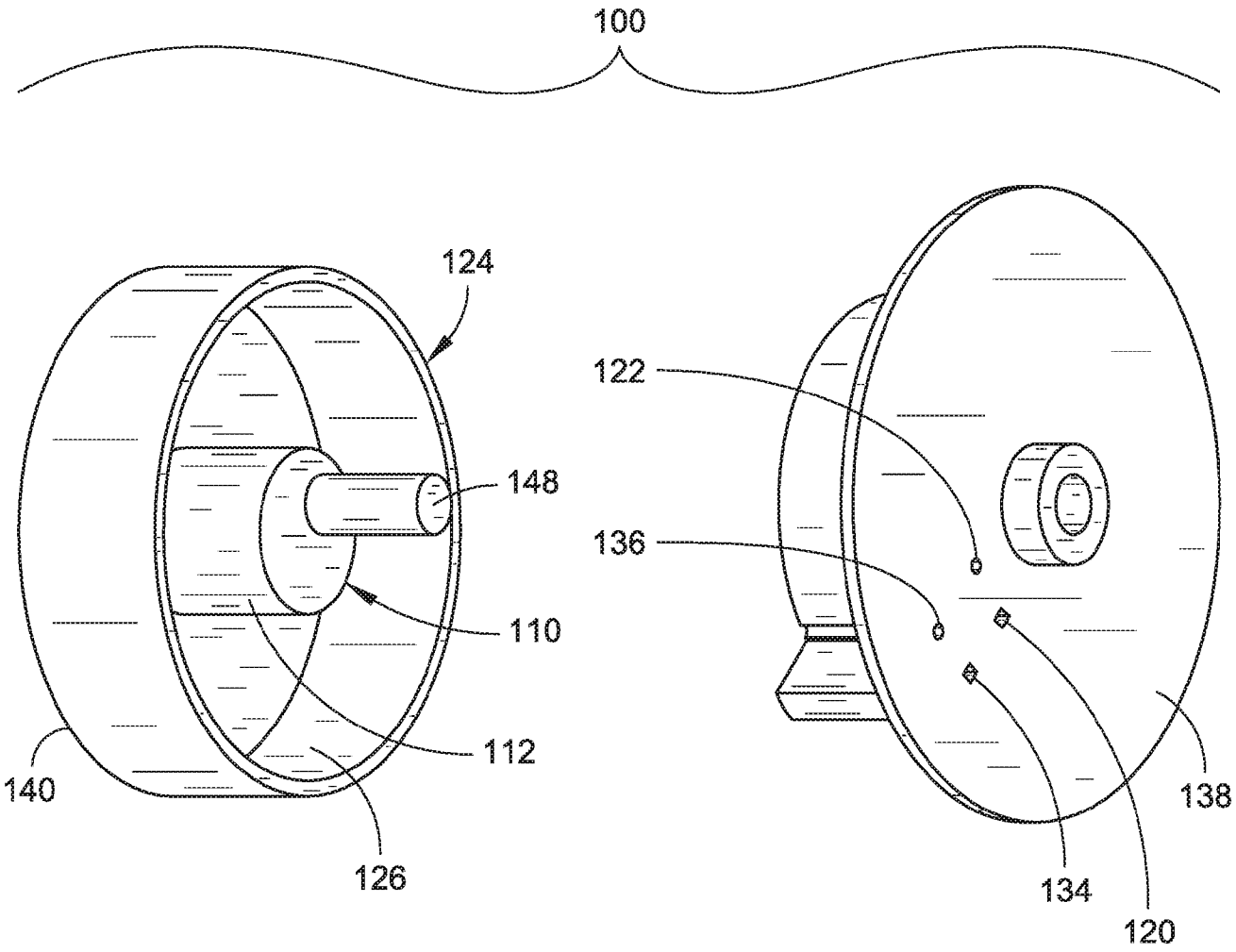
FIG. 6 is an exploded perspective view of the positive displacement device illustrated in FIG. 4.
Figure 7:
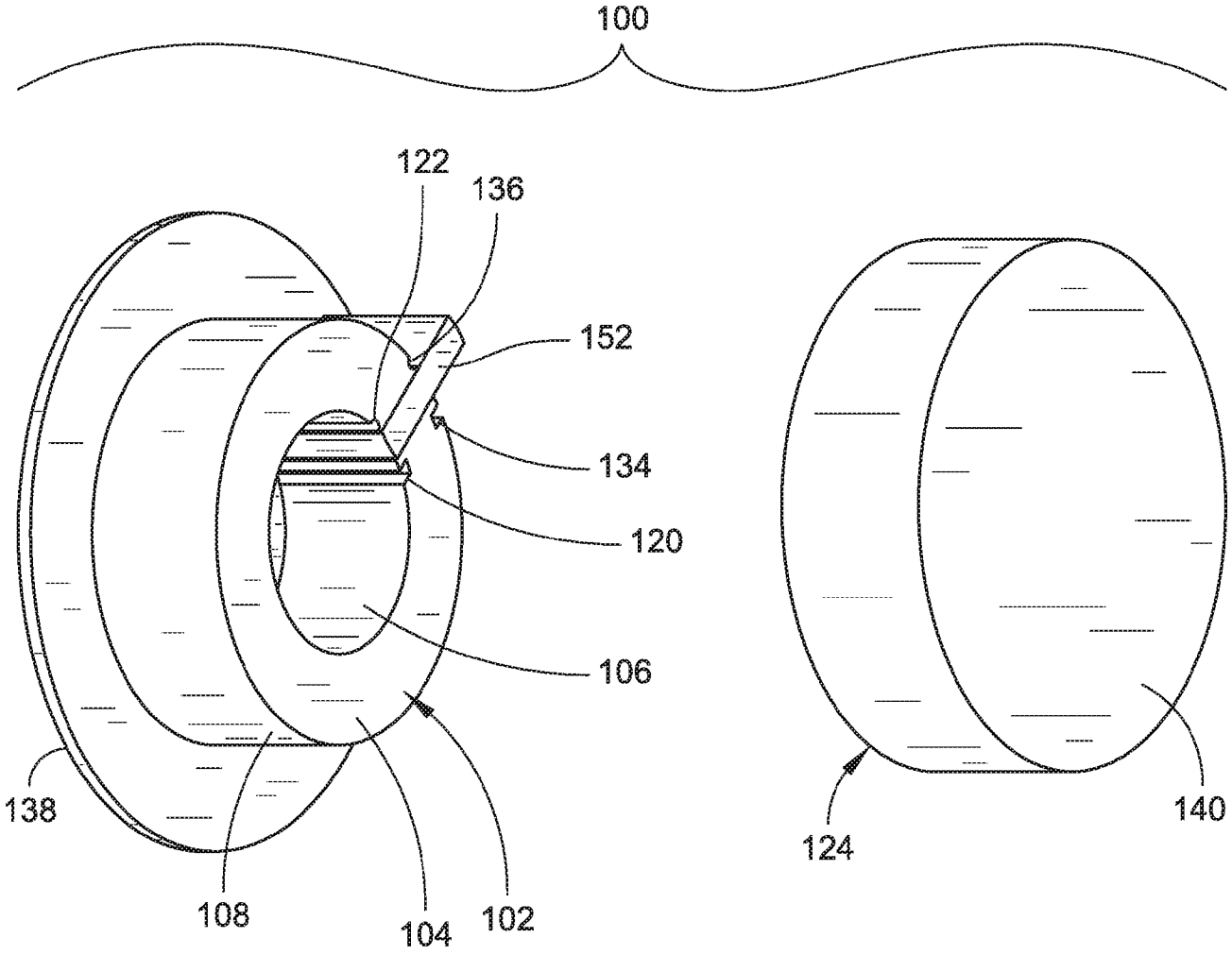
FIG. 7 is another exploded perspective view of the positive displacement device illustrated in FIG. 4.
Figure 8:
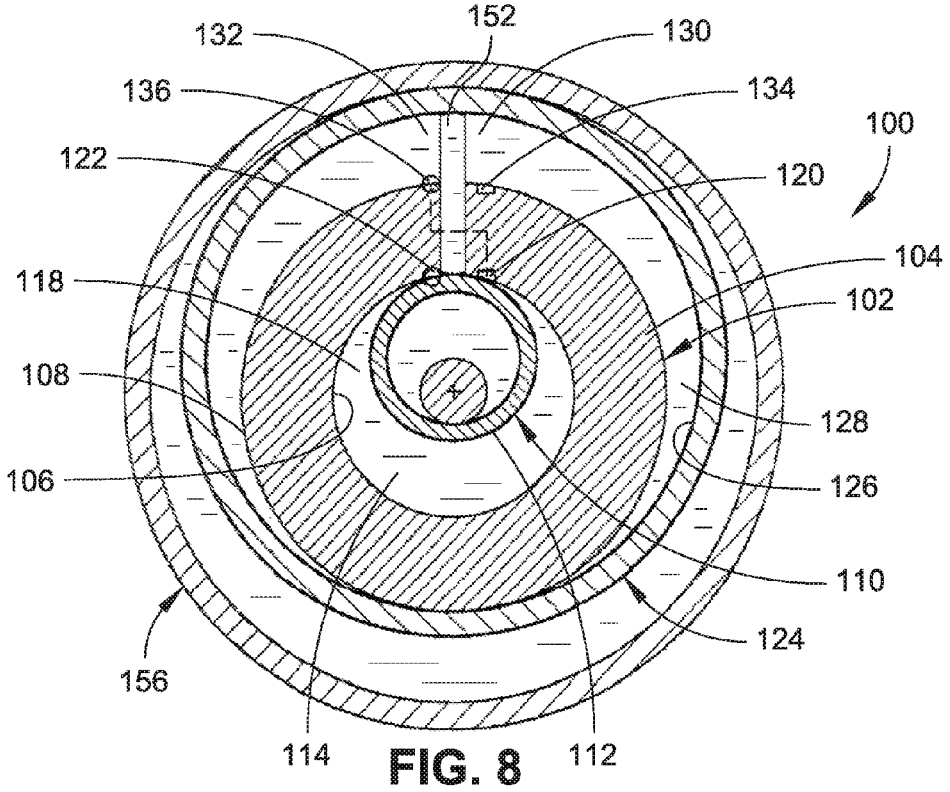
FIG. 8 is a cross-sectional end view illustrating a positive displacement device including a first cylinder, a second cylinder disposed within the first cylinder, and a third cylinder disposed around the first cylinder, where the positive displacement device is shown at zero degrees (0°) of shaft rotation in accordance with an example embodiment of the present disclosure.
Figure 9:
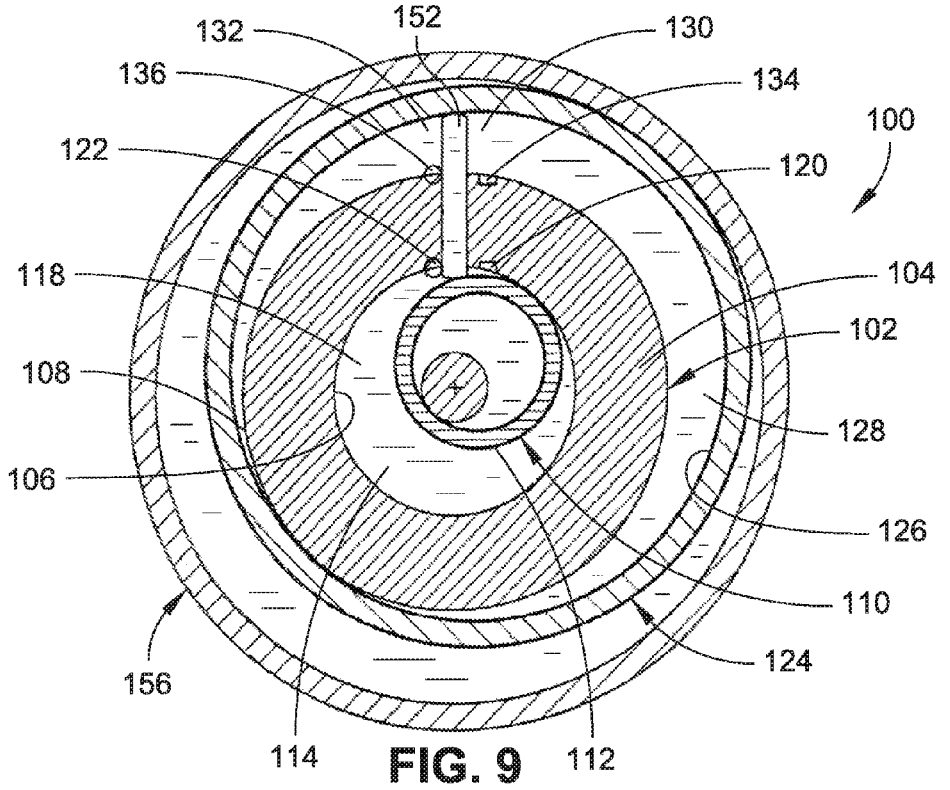
FIG. 9 is another cross-sectional end view of the positive displacement device illustrated in FIG. 8, where the positive displacement device is shown at forty-five degrees (45°) of shaft rotation in accordance with an example embodiment of the present disclosure.
Figure 10:
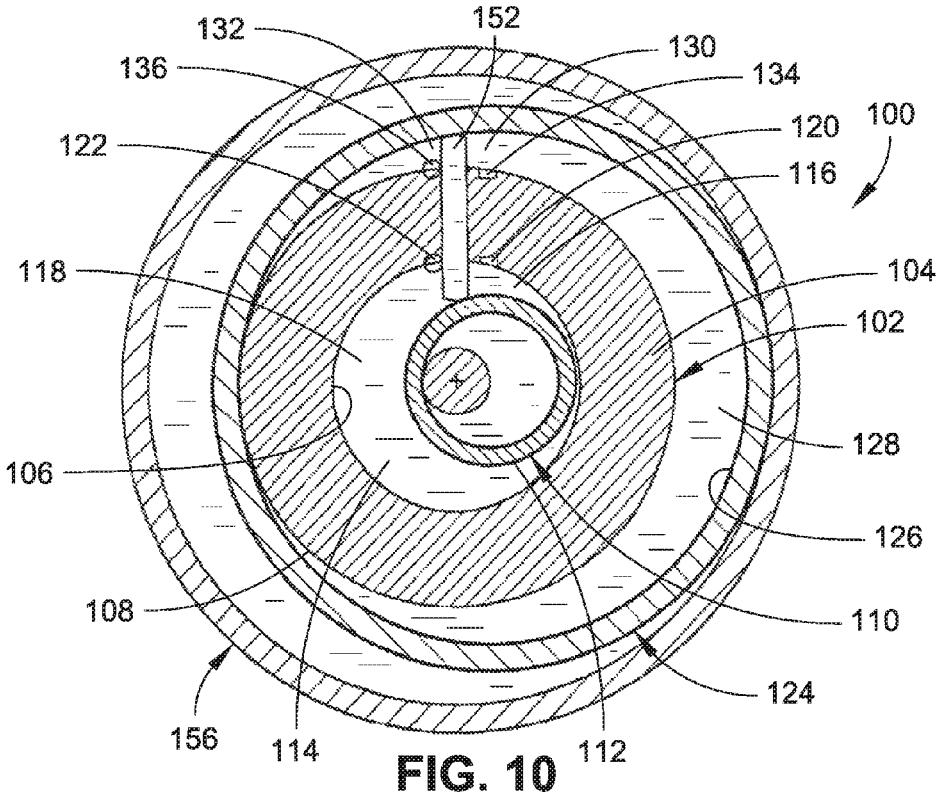
FIG. 10 is another cross-sectional end view of the positive displacement device illustrated in FIG. 8, where the positive displacement device is shown at ninety degrees (90°) of shaft rotation in accordance with an example embodiment of the present disclosure.
Figure 11:
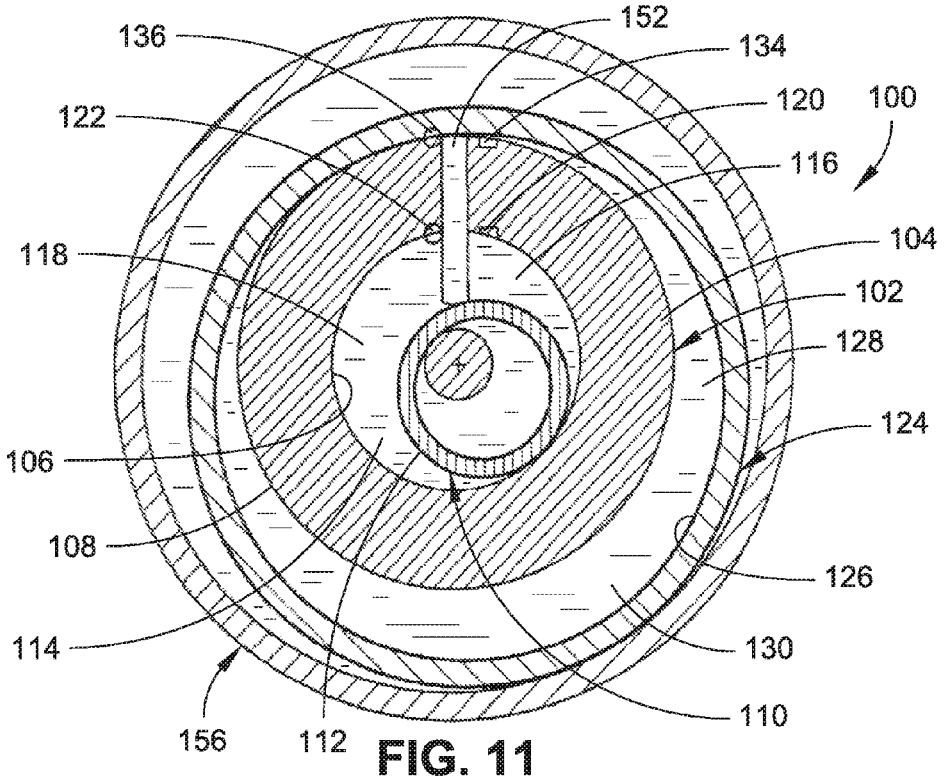
FIG. 11 is another cross-sectional end view of the positive displacement device illustrated in FIG. 8, where the positive displacement device is shown at one hundred and thirty-five degrees (135°) of shaft rotation in accordance with an example embodiment of the present disclosure.
Figure 12:
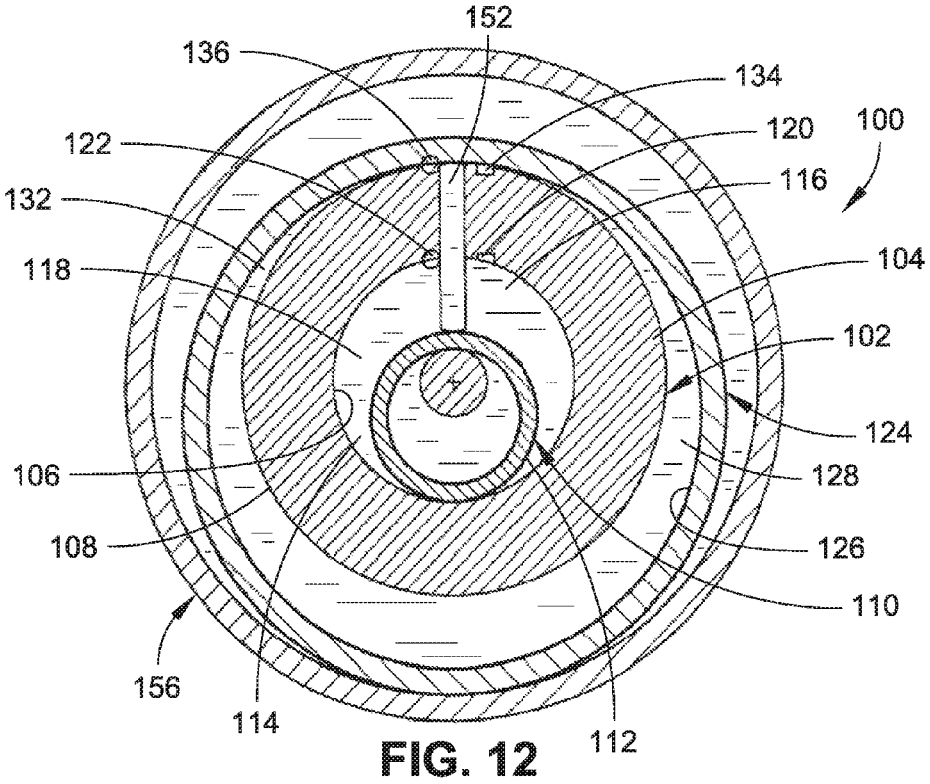
FIG. 12 is another cross-sectional end view of the positive displacement device illustrated in FIG. 8, where the positive displacement device is shown at one hundred and eighty degrees (180°) of shaft rotation in accordance with an example embodiment of the present disclosure.
Figure 13:
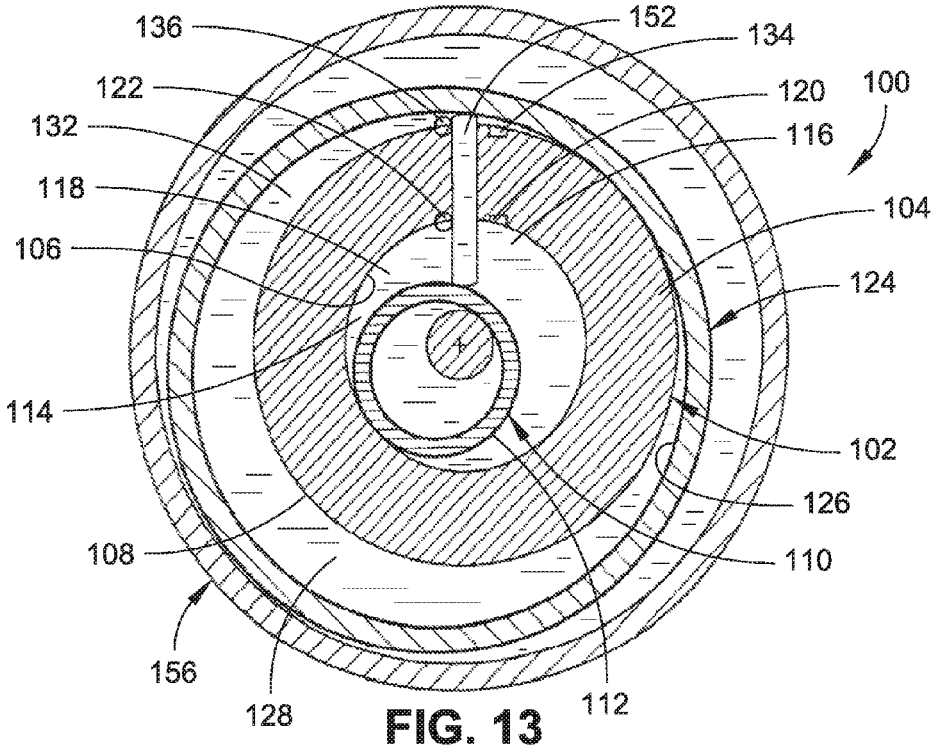
FIG. 13 is another cross-sectional end view of the positive displacement device illustrated in FIG. 8, where the positive displacement device is shown at two hundred and twenty-five degrees (225°) of shaft rotation in accordance with an example embodiment of the present disclosure.
Figure 14:
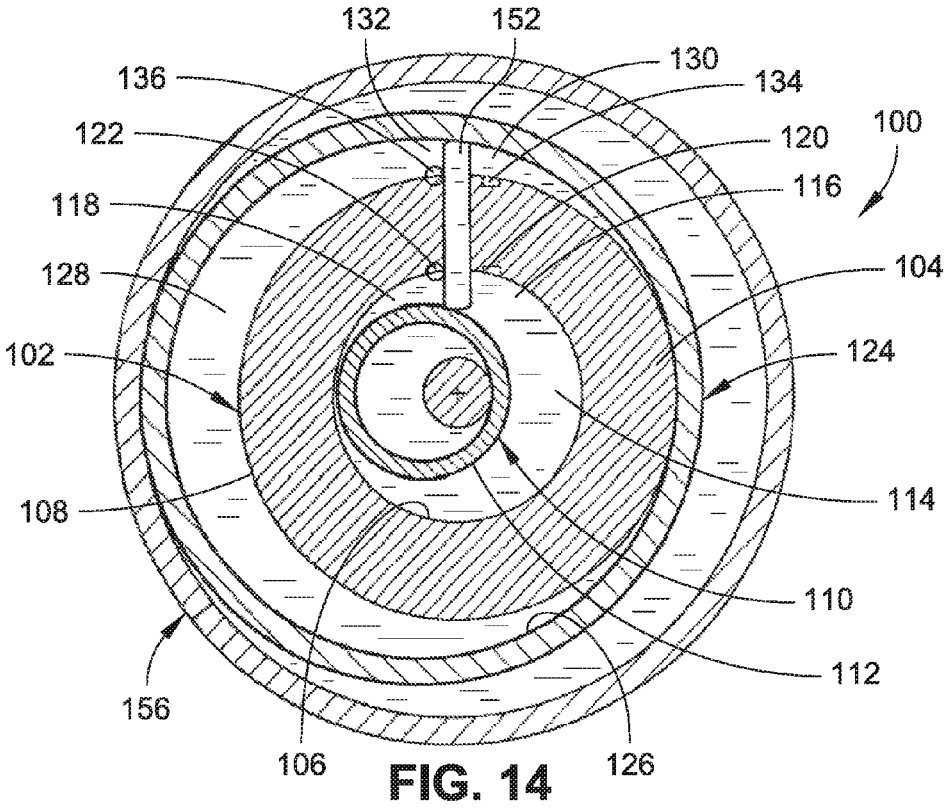
FIG. 14 is another cross-sectional end view of the positive displacement device illustrated in FIG. 8, where the positive displacement device is shown at two hundred and seventy degrees (270°) of shaft rotation in accordance with an example embodiment of the present disclosure.
Figure 15:
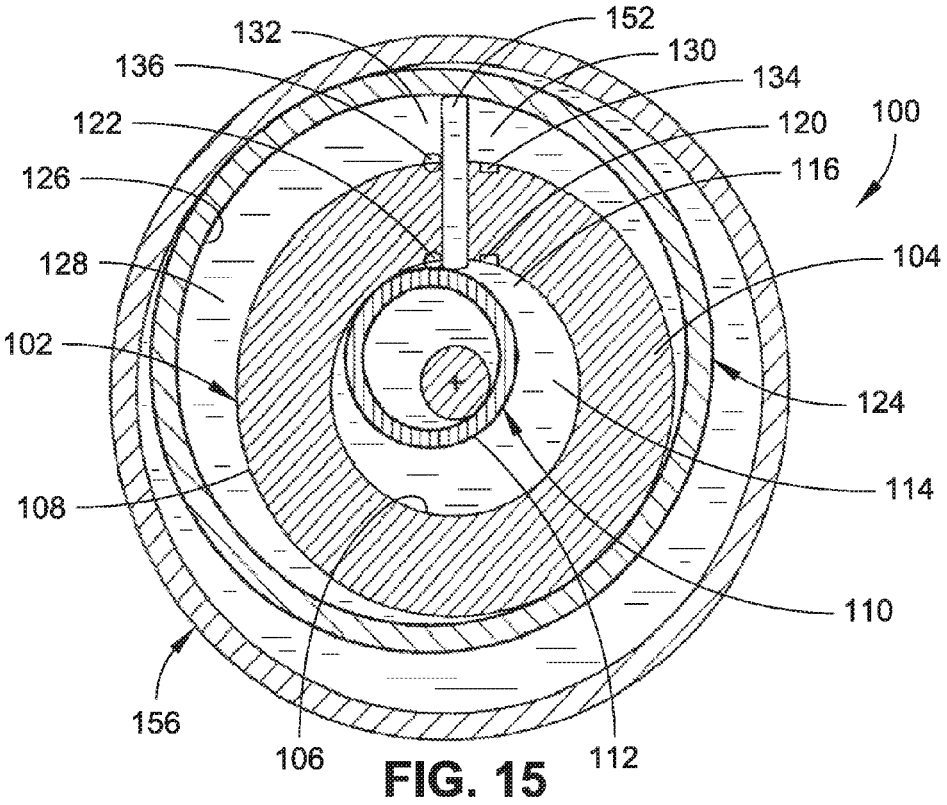
FIG. 15 is another cross-sectional end view of the positive displacement device illustrated in FIG. 8, where the positive displacement device is shown at three hundred and fifteen degrees (315°) of shaft rotation in accordance with an example embodiment of the present disclosure.

With reference to FIGS. 1 through 4C, in some embodiments, a positive displacement device 100 can be constructed using a through-shaft design. For example, a crankshaft 142 may extend through the end plates 138 and 140. A drive mechanism, such as a motor, can be used to drive the second and third cylinders 110 and 124 in orbit with respect to the first cylinder 102. Referring to FIG. 4, the end plate 138 can include a journal bearing 144, and the end plate 140 can include an eccentric journal bearing 146. This configuration may facilitate reduced shaft bearing loads and/or shaft deflection (e.g., because a through-shaft design allows the piston load to be shared by two shaft bearings). Further, a reduction of non-symmetric axial thrust between fixed and orbiting pistons can be achieved (e.g., when the eccentric bearing is located in the plane of the piston). In other embodiments, the positive displacement device 100 does not necessarily use a through-shaft design. For example, with reference to FIGS. 5 through 7, the second cylinder 110 can be connected to a shaft 148 that passes through a bearing in the end plate 138.

Referring now to FIGS. 8 through 15, the partition between the interior surface 106 of the first cylinder 102 and the exterior surface 112 of the second cylinder 110, and the partition between the exterior surface 108 of the first cylinder 102 and the interior surface 126 of the third cylinder 124, can each be formed by a single vane 152 slidably extending through a vane slot 154 radially formed in the wall 104 of the first cylinder 102 and moveable with respect to the second cylinder 110 and the third cylinder 124. The vane 152 is in sealing contact with the wall 104 of the first cylinder 102, the exterior surface 112 of the second cylinder 110, and the interior surface 126 of the third cylinder 124. The vane 152 has a first tip in sealing contact with the exterior surface 112 of the second cylinder 110 and a second tip in sealing contact with the interior surface 126 of the third cylinder 124. The vane 152 provides a barrier between the high and low pressure regions. For example, in some embodiments, the second and third cylinders 110 and 124 can rotate randomly (e.g., allowing for even wear between the mating surfaces, heat distribution, etc.). In other embodiments, an anti-rotation device can be used to prevent or minimize rotation of the second and third cylinders 110 and 124 as the cylinders orbit the center of the first cylinder 102. In some embodiments, a separate vane can be included to form each partition (e.g., each using a vane spring and/or another biasing mechanism to maintain contact with the interior and/or exterior surfaces of the cylinders).

In embodiments of the disclosure, the first and second intake ports 120 and 134 are provided for supplying a fluid or gas to the positive displacement device 100, while the first and second exhaust ports 122 and 136 are provided for supplying the fluid or gas from the positive displacement device 100. In some embodiments, the first cylinder 102, the second cylinder 110, and the third cylinder 124 can be placed within an outer shell, or an outer compressor housing 156. As the second and third cylinders 110 and 124 orbit the center of the first cylinder 102, pockets of space, or compression cavities, are created adjacent to the first and second intake ports 120 and 134. Fluid or gas enters these compression cavities via the first and second intake ports 120 and 134. As the second and third cylinders 110 and 124 continue to orbit the center of the first cylinder 102, the compression cavities are separated from the first and second intake ports 120 and 134 and migrate toward the first and second exhaust ports 122 and 136. When the compression cavities are adjacent to the first and second exhaust ports 122 and 136, the fluid or gas is supplied from the positive displacement device 100. For instance, compressed gas may be supplied to a storage tank, or the like.

It should be noted that while two second and third cylinders 110 and 124 are illustrated in the accompanying figures, more or fewer cylinders may be included with a positive displacement device 100. For example, the third cylinder 124 may be replaced with a compression spring and/or another biasing mechanism for biasing the vane 152 against the first cylinder 102. Further, additional cylinders and/or additional vanes may be included to create additional compression chambers.

In embodiments of the disclosure, surfaces on both the second and third cylinders 110 and 124, and the first cylinder 102, are circular in cross-section, or formed by constant radii. Because the vane 152 inserted between the second and third cylinders 110 and 124 is a separate part, the constant radius compression cavity surfaces on the second and third cylinders 110 and 124, and the first cylinder 102, can be machined using conventional turning processes, which may be performed with greater accuracy and/or at a comparatively lower cost (e.g., when compared to a non-constant radius configuration).

Figure 16:
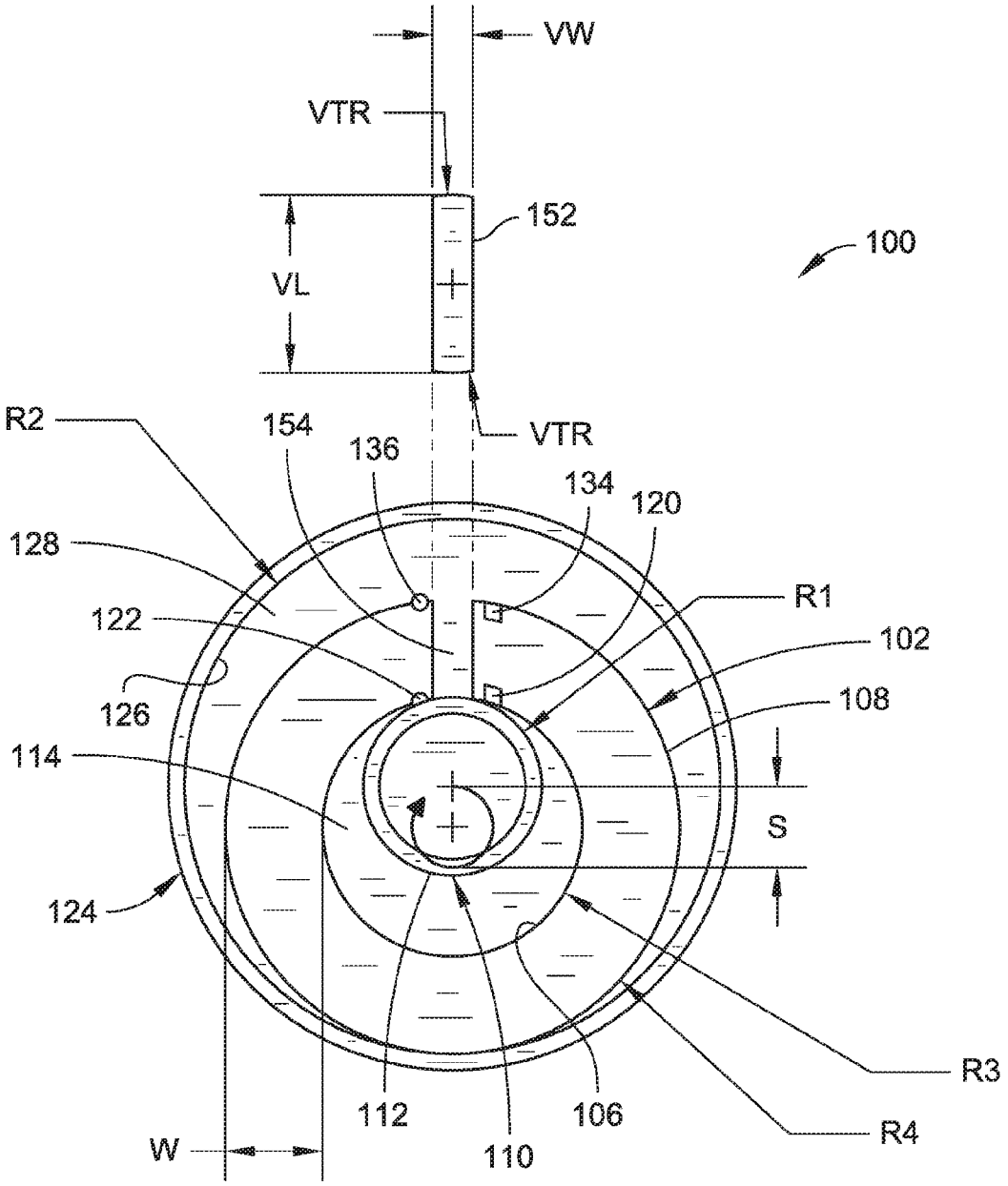
FIG. 16 is a partial exploded end view illustrating a positive displacement device in accordance with example embodiments of the present disclosure.

Referring now to FIG. 16, in some embodiments, a series of mathematical equations can be used to define the relationships between the geometry of the first cylinder 102, the second and third cylinders 110 and 124, and four defining radii. These relationships may provide a continuous seal in the compression cavities. For the following discussion, S is equal to the stroke, or the travel distance of the second and third cylinders 110 and/or 124 in a straight line (e.g., twice the crankshaft eccentricity). W is equal to the thickness of the wall 104 of the first cylinder 102. R1 is equal to the outside radius of the exterior surface 112 of the second cylinder 110, or the radius of the compression surface of the second cylinder 110. This radius may be selected based upon space requirements. For example, if the central region of the second cylinder 110 is enlarged to pass the crankshaft 142 through, the outside radius R1 of the second cylinder 110 may be determined by space requirements for the compressor shaft, eccentric, and eccentric bearing, plus a minimum wall thickness for the second cylinder 110.

R2, which is equal to the inside radius of the interior surface 126 of the third cylinder 124, or the radius of the compression surface of the third cylinder 124, can then be determined as follows:

$$R2=R1+S+W$$

R3, which is equal to the inside radius of the interior surface 106 of the first cylinder 102, or the radius of the inside compression surface of the first cylinder 102, can be determined as follows:

$$R3=R1+S/2$$

R4, which is equal to the outside radius of the exterior surface 108 of the first cylinder 102, or the radius of the outer compression surface of the first cylinder 102, can be determined as follows:

$$R4=R3+W$$

In embodiments of the disclosure, VW, which is equal to the width of the vane 152, can be selected to allow the vane 152 to travel radially through the first cylinder 102, while providing minimum clearance for gas sealing purposes. The width of the vane 152 may be selected based upon space requirements, and the width of the vane slot 154 in the first cylinder 102 may be equal to the vane width VW plus a desired seal clearance. It should be noted that a comparatively small vane width VW may increase the bending stress on the vane 152 (e.g., due to gas pressure and/or friction between the vane 152 and the second and third cylinders 110 and 124). Further, a vane width VW that permits the second and third cylinders 110 and 124 to contact the edge of the vane 152 may cause a loss of vane seal and/or excessive wear between the vane 152 and the orbiting surfaces the second and third cylinders 110 and 124. Thus, the width of the vane 152 can be selected to be greater than at least a minimum vane width. For instance, $VW_m$, which is equal to this minimum vane width, can be determined as follows:

$$VW_m = S*(R2-R1)/(R2+R1)$$

VL, which is equal to the length of the vane 152, or the distance between the two outer ends of the vane, can be determined as follows:

$$VL = R2-R1$$

In embodiments of the disclosure, the vane 152 includes a tip radius, or a radius at the two outer ends of the vane. VTR, which is equal to this vane tip radius, can be determined as follows:

$$VTR = VL/2$$

It should be noted that the positive displacement device 100 may include other dimensional relationships and that the dimensional relationships heretofore described are provided by way of example only and not meant to limit the present disclosure. Thus, the positive displacement device 100 of the present invention is not necessarily limited to these dimensional relationships. Additionally, for the purposes of the present disclosure, the term "equal to" shall be understood to mean equal to within the limits of precision machinability.

Because the surfaces on the second and third cylinders 110 and 124 are circular, rotational orientation of the second and third cylinders 110 and 124 is not necessarily required. Thus, the need for an external anti-rotation device may be eliminated, allowing the second and third cylinders 110 and 124 to freely rotate while orbiting the center of the first cylinder 102. A cost savings may be achieved by eliminating the anti-rotation device. Additionally, wear on the surfaces of the second and third cylinders 110 and 124, which may be caused by the vane 152, the first cylinder 102, and/or the housing 156, can be uniformly distributed over the entire mating surfaces (e.g., rather than being concentrated in a small region). Additionally, free rotation of the second and third cylinders 110 and 124 can uniformly distribute the heat of gas compression over the entire mating surfaces (e.g., again, rather than being concentrated in a small region). The apparatus, systems, and techniques described herein can provide a reduced peak wear rate and/or uniformity of temperature over the second and third cylinders 110 and 124, and reduction of temperatures in the high pressure region, resulting in less part distortion, lower gas temperatures, and so forth.

It should be noted that while the compression cavities created by the inner and outer second and third cylinders 110 and 124 may share a common vane 152, they can act as separate compression chambers, sequenced one hundred and eighty degrees (180°) apart. The apparatus, systems, and techniques described herein can reduce peak torque for single stage compressors, and may provide a two stage compressor design using the second and third cylinders 110 and 124. For a two stage design, the larger outer cavity can be used for the first stage, and the smaller inner cavity can be used for the second stage. For example, in some embodiments, the first intake port 120 can be connected to (e.g., in fluid communication with) the second exhaust port 136 to form a two stage compressor. In this manner, fluid may flow from the second intake port 134 into the outer cavity 128 and from the outer cavity 128 to the second exhaust port 136 (forming a first compressor stage), from the second exhaust port 136 to the first intake port 120, and then from the first intake port 120 into the inner cavity 114 and from the inner cavity 114 to the first exhaust port 122 (forming a second compressor stage).

It is noted that a large contributor to vane wear in typical stationary vane compressors is the pressure differential across the vane. Since these are predominantly single stage compressors, the maximum pressure differential across the vane is the discharge pressure minus the suction pressure. In the two stage version of the positive displacement device 100 described herein, the intermediate pressure is between the suction pressure and the discharge pressures. The differential pressure across the first stage end of the vane is the intermediate pressure minus the suction pressure. The differential pressure across the second stage end of the vane is the discharge pressure minus the intermediate pressure. Both of these differential pressures and resulting vane forces may be significantly lower than those of a typical stationary vane compressor. Thus, the resulting vane wear of a positive displacement device 100 may be comparatively lower than that of a typical stationary vane compressor.

As described herein, the center region of a positive displacement device 100 can be enlarged, moving the discharge port and compression cavities radially outward, without increasing the dead space adjacent to the discharge port at the end of the compression cycle. This configuration may yield a high compression ratio design. Enlarging the central region can be done to allow room for an eccentric, an eccentric bearing, a shaft, and shaft bearings, with the shaft passing through the eccentric and supported by shaft bearings on each side of the eccentric. This can reduce the radial forces on the shaft bearings, allowing the use of smaller bearings and/or shafting. Additionally, the eccentric can be located axially within the plane of the second and third cylinders 110 and 124 and the first cylinder 102, allowing radial pressure forces between the second and third cylinders 110 and 124 to pass through the plane of the eccentric bearing and reduce non-symmetric axial thrust between the second and third cylinders 110 and 124 and the first cylinder 102.

A positive displacement device 100 may have one or both of the second and third cylinders 110 and 124, and/or the first cylinder 102, coated with an abradable coating of sufficient thickness to cause interference at all sealing surfaces between the members. During the manufacturing or assembly sequence, the second and third cylinders 110 and 124, and the first cylinder 102, can be assembled and operated, causing the excess coating to abrade away leaving a near perfect match between the surfaces of the second and third cylinders 110 and 124 and the first cylinder 102. This process may reduce the need for precise machining.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A positive displacement device comprising:

a first cylinder having a wall with an interior surface and an exterior surface;

a vane slidably extending through the wall of the first cylinder, the vane having a first tip and a second tip;

a second cylinder disposed within the first cylinder, the second cylinder having an exterior surface, the interior surface of the first cylinder and the exterior surface of the second cylinder defining an inner cavity therebetween, the vane moveable with respect to the second cylinder and in sealing contact between the interior surface of the first cylinder and the exterior surface of the second cylinder to divide the inner cavity into a first inner region and a second inner region, the first tip of the vane in sealing contact with the exterior surface of the second cylinder;

a first intake port in fluid communication with the first inner region of the inner cavity;

a first exhaust port in fluid communication with the second inner region of the inner cavity;

a third cylinder disposed around the first cylinder, the third cylinder having an interior surface, the exterior surface of the first cylinder and the interior surface of the third cylinder defining an outer cavity therebetween, the vane moveable with respect to the third cylinder and in sealing contact between the exterior surface of the first cylinder and the interior surface of the third cylinder to divide the outer cavity into a first outer region and a second outer region, the second tip of the vane in sealing contact with the interior surface of the third cylinder;

a second intake port in fluid communication with the first outer region of the outer cavity;

a second exhaust port in fluid communication with the second outer region of the outer cavity;

a first sealing interface for sealing first ends of the inner cavity and the outer cavity; and a second sealing interface for sealing second ends of the inner cavity and the outer cavity, wherein the second cylinder and the third cylinder are configured to orbit with respect to the first cylinder to create alternating regions of high pressure and low pressure in the first and second inner regions of the inner cavity and the first and second outer regions of the outer cavity.

2. The positive displacement device as recited in claim 1, wherein the positive displacement device has a stroke defined by a travel distance of the second cylinder and the third cylinder in a straight line, and the vane has a width greater than at least approximately the stroke multiplied by an inside radius of the third cylinder minus an outside radius of the second cylinder and divided by the inside radius of the third cylinder plus the outside radius of the second cylinder.

3. The positive displacement device as recited in claim 1, wherein the vane has a length equal to a radial distance between the exterior surface of the second cylinder and the interior surface of the third cylinder, and a tip radius equal to one-half of the length of the vane.

4. The positive displacement device as recited in claim 1, further comprising a first end plate for connecting the second cylinder and the third cylinder together, wherein the first end plate forms one of the first sealing interface or the second sealing interface.

5. The positive displacement device as recited in claim 4, further comprising a second end plate connected to the first cylinder, wherein the second end plate forms the other of the first sealing interface or the second sealing interface.

6. The positive displacement device as recited in claim 1, wherein the first intake port is in fluid communication with the second exhaust port to form a two stage compressor.

7. The positive displacement device as recited in claim 1, further comprising a through-shaft coupled with at least one of the first cylinder or the second and third cylinders.

8. A positive displacement device comprising:

a first cylinder having an interior surface and an exterior surface;

a second cylinder disposed within the first cylinder, the second cylinder having an exterior surface, the interior surface of the first cylinder and the exterior surface of the second cylinder defining an inner cavity therebetween;

a first partition between the interior surface of the first cylinder and the exterior surface of the second cylinder to divide the inner cavity into a first inner region and a second inner region, the first partition movable with respect to the second cylinder and having a first tip in sealing contact with the exterior surface of the second cylinder;

a first intake port in fluid communication with the first inner region of the inner cavity;

a first exhaust port in fluid communication with the second inner region of the inner cavity;

a third cylinder disposed around the first cylinder, the third cylinder having an interior surface, the exterior surface of the first cylinder and the interior surface of the third cylinder defining an outer cavity therebetween;

a second partition between the exterior surface of the first cylinder and the interior surface of the third cylinder to divide the outer cavity into a first outer region and a second outer region, the second partition movable with respect to the third cylinder and having a second tip in sealing contact with the interior surface of the third cylinder;

a second intake port in fluid communication with the first outer region of the outer cavity;

a second exhaust port in fluid communication with the second outer region of the outer cavity;

a first sealing interface for sealing first ends of the inner cavity and the outer cavity; and a second sealing interface for sealing second ends of the inner cavity and the outer cavity, wherein the second cylinder and the third cylinder are configured to orbit with respect to the first cylinder to create alternating regions of high pressure and low pressure in the first and second inner regions of the inner cavity and the first and second outer regions of the outer cavity.

9. The positive displacement device as recited in claim 8, wherein the first partition and the second partition are each formed by a vane slidably extending through a wall of the first cylinder, the vane in sealing contact with the wall of the first cylinder, the exterior surface of the second cylinder, and the interior surface of the third cylinder.

10. The positive displacement device as recited in claim 9, wherein the positive displacement device has a stroke defined by a travel distance of the second cylinder and the third cylinder in a straight line, and the vane has a width greater than at least approximately the stroke multiplied by an inside radius of the third cylinder minus an outside radius of the second cylinder and divided by the inside radius of the third cylinder plus the outside radius of the second cylinder.

11. The positive displacement device as recited in claim 9, wherein the vane has a length equal to a radial distance between the exterior surface of the second cylinder and the interior surface of the third cylinder, and a tip radius equal to one-half of the length of the vane.

12. The positive displacement device as recited in claim 8, further comprising a first end plate for connecting the second cylinder and the third cylinder together, wherein the first end plate forms one of the first sealing interface or the second sealing interface.

13. The positive displacement device as recited in claim 12, further comprising a second end plate connected to the first cylinder, wherein the second end plate forms the other of the first sealing interface or the second sealing interface.

14. The positive displacement device as recited in claim 8, wherein the first intake port is in fluid communication with the second exhaust port to form a two stage compressor.

15. A positive displacement device comprising:

a first cylinder having an interior surface and an exterior surface;

a second cylinder disposed within the first cylinder, the second cylinder having an exterior surface, the interior surface of the first cylinder and the exterior surface of the second cylinder defining an inner cavity therebetween;

a first partition between the interior surface of the first cylinder and the exterior surface of the second cylinder to divide the inner cavity into a first inner region and a second inner region, the first partition movable with respect to the second cylinder and having a first tip in sealing contact with the exterior surface of the second cylinder;

a first intake port in fluid communication with the first inner region of the inner cavity;

a first exhaust port in fluid communication with the second inner region of the inner cavity;

a third cylinder disposed around the first cylinder, the third cylinder having an interior surface, the exterior surface of the first cylinder and the interior surface of the third cylinder defining an outer cavity therebetween;

a second partition between the exterior surface of the first cylinder and the interior surface of the third cylinder to divide the outer cavity into a first outer region and a second outer region, the second partition movable with respect to the third cylinder and having a second tip in sealing contact with the interior surface of the third cylinder;

a second intake port in fluid communication with the first outer region of the outer cavity;

a second exhaust port in fluid communication with the second outer region of the outer cavity, the first intake port in fluid communication with the second exhaust port;

a first sealing interface for sealing first ends of the inner cavity and the outer cavity; and a second sealing interface for sealing second ends of the inner cavity and the outer cavity, wherein the second cylinder and the third cylinder are configured to orbit with respect to the first cylinder to create alternating regions of high pressure and low pressure in the first and second inner regions of the inner cavity and the first and second outer regions of the outer cavity.

16. The positive displacement device as recited in claim 15, wherein the first partition and the second partition are each formed by a vane slidably extending through a wall of the first cylinder, the vane in sealing contact with the wall of the first cylinder, the exterior surface of the second cylinder, and the interior surface of the third cylinder.

17. The positive displacement device as recited in claim 16, wherein the positive displacement device has a stroke defined by a travel distance of the second cylinder and the third cylinder in a straight line, and the vane has a width greater than at least approximately the stroke multiplied by an inside radius of the third cylinder minus an outside radius of the second cylinder and divided by the inside radius of the third cylinder plus the outside radius of the second cylinder.

18. The positive displacement device as recited in claim 16, wherein the vane has a length equal to a radial distance between the exterior surface of the second cylinder and the interior surface of the third cylinder, and a tip radius equal to one-half of the length of the vane.

19. The positive displacement device as recited in claim 15, further comprising a first end plate for connecting the second cylinder and the third cylinder together, wherein the first end plate forms one of the first sealing interface or the second sealing interface.

20. The positive displacement device as recited in claim 19, further comprising a second end plate connected to the first cylinder, wherein the second end plate forms the other of the first sealing interface or the second sealing interface.

* * * * *